US006949033B1

(12) United States Patent
Mydland

(10) Patent No.: US 6,949,033 B1
(45) Date of Patent: Sep. 27, 2005

(54) ADJUSTABLE GOLF TEE PRECISION SETTING DEVICE

(76) Inventor: Don R. Mydland, 2277 Broderson Ave., Los Osos, CA (US) 93402

( * ) Notice: Subject to any disclaimer, the term of this patent is extended or adjusted under 35 U.S.C. 154(b) by 0 days.

(21) Appl. No.: 10/726,431

(22) Filed: Dec. 3, 2003

(51) Int. Cl.[7] ..... A63B 57/00
(52) U.S. Cl. ..... 473/386
(58) Field of Search ..... 473/386–403

(56) References Cited

U.S. PATENT DOCUMENTS

| | | | | |
|---|---|---|---|---|
| 1,634,652 | A | 7/1927 | Czichos | |
| 1,852,956 | A | 4/1932 | Czichos | |
| 1,902,682 | A | 3/1933 | Walrath | |
| 2,606,764 | A * | 8/1952 | Mason | 473/386 |
| 2,943,856 | A | 7/1960 | Eimerman | |
| 3,074,719 | A | 1/1963 | McKee | |
| 3,312,468 | A | 4/1967 | Lynch | |
| 3,333,848 | A | 8/1967 | Budzinski | |
| 3,540,727 | A | 11/1970 | Hoe, Jr. | |
| 3,658,331 | A | 4/1972 | Driscoll | |
| 3,671,036 | A | 6/1972 | Rubino | |
| 3,671,037 | A | 6/1972 | Murdock, Jr. | |
| 4,142,719 | A | 3/1979 | Blood | |
| 4,660,837 | A | 4/1987 | Bressie | |
| 5,370,388 | A * | 12/1994 | Wehner | 473/386 |
| 5,643,113 | A * | 7/1997 | Rodgers | 473/386 |
| 5,669,646 | A | 9/1997 | Fiocca et al. | |
| 6,338,685 | B1 | 1/2002 | Posluszny | |
| 6,394,515 | B1 | 5/2002 | Keleher et al. | |
| 2002/0183138 | A1 | 12/2002 | Malcolm | |

* cited by examiner

*Primary Examiner*—Steven Wong
(74) *Attorney, Agent, or Firm*—William Keyworth; Bill & Mary Lou Inc.

(57) ABSTRACT

A device to hold, set, and release a golf tee in the ground precisely set height of the tee above the ground surface is described. The device is operated with one hand incorporating the golf ball into the setting operation to provide a quick, efficient, and accurate placement of the golf tee. The device retains the golf tee until released after being set in the ground. The device in gripping the tee holds the tee head against a convex tee chamber surface that is the desired tee height above the device bottom. Inserting the tee in the ground until the device bottom contacts the ground sets the tee to this desired height. The tee head height is adjustable by varying the location of the tee chamber with respect to the bottom of the device.

17 Claims, 10 Drawing Sheets

ADJUSTABLE GOLF TEE PRECISION SETTING DEVICE

CROSS-REFERENCE TO RELATED APPLICATIONS

Not Applicable.

STATEMENT REGARDING FEDERALLY SPONSORED RESEARCH AND DEVELOPMENT

Not Applicable.

REFERENCE TO A MICROFICHE APPENDIX

Not Applicable.

BACKGROUND OF THE INVENTION

1. Field of the Invention

This invention relates to a device that grips a common golf ball tee to provide a method of tee setting that allows the user to set the tee to a precisely set depth, and then release the tee to maintain it at the inserted location while removing the device from contact with the tee. Tee setting means to insert the tee into the ground. After setting the tee, the user may then install a golf ball on the tee. The installed golf ball is at a consistent height above the ground thus allowing the golfer repeatability in the driving of the golf ball with a golf club.

2. Description of Related Art

Devices for inserting a golf ball tee into the ground are known in the art. The devices described can be categorized. One category of device attempts to insert the tee into the ground with the ball installed on the tee. Examples of this type of device are U.S. Pat. No. 2,943,856 (Eimerman), U.S. Pat. No. 3,312,468 (Lynch), U.S. Pat. No. 6,338,685 (Posluszny) and U.S. Pat. No. 6,394,515 (Kelcher et al). This type of device has an inherent problem in addition to the complex operation of the device. That is the ball frequently falls off the tee when removing the device after inserting the tee into the ground. This requires time to retrieve the ball and replace it on the tee.

A second category is devices that insert the tee into the ground without a means of holding the tee in the device. Examples of this type of device are U.S. Pat. No. 1,852,956 (Czichos), U.S. Pat. No. 1,634,652 (Czichos), U.S. Pat. No. 3,540,727 (Solomon), U.S. Pat. No. 3,658,331 (Driscoll), U.S. Pat. No. 3,671,036 (Rubino), U.S. Pat. No. 5,885,174 (Barnes), and U.S. Patent Application Publication Number U.S. 2002/01833138 (Malcolm). The normal method of inserting a tee in the ground, is to place a ball on the head of the tee and with both the ball and tee grasped in the hand, press on the ball to insert the tee into the ground. These devices provide a means of setting the tee height but their use takes away the ease and easily applied force of having the smooth ball against the hand. They require the user to hold the tee in the device by some means, either using two hands, or by gripping the device and the tee with one hand. Their use is at best awkward, and at worst uncomfortable.

A third category of device provides a means of gripping the tee to be inserted into the ground. Examples are U.S. Pat. No. 1,902,682 (Walrath), U.S. Pat. No. 2,606,764 (Mason), U.S. Pat. No. 3,074,719 (McKee), U.S. Pat. No. 3,333,848 (Budzinski), U.S. Pat. No. 3,671,037 (Murdock, Jr.), U.S. Pat. No. 4,142,719 (Blood), and U.S. Pat. No. 5,669,646 (Fiocca et al).

U.S. Pat. No. 5,669,646 (Fiocca et al) discloses a long handled tee-positioning device meant for operation from a standing position. The mechanism for holding the tee grips it at the tee body between two spring-loaded jaws that are opened by the tee head being forced between the jaws by the end of a rod. This type of mechanism has a high probability of damaging the tee ball-setting surface since the rod end is essentially flat and can require considerable force to overcome the jaw spring tension in addition to the force required to insert the tee into the ground.

U.S. Pat. No. 4,142,719 (Blood) describes a tee ground insertion device that holds the tee by the tee head using 3-points of a spring or arm. Release of the tee requires the ground friction against the tee body overcome the spring tension against the head. Such a mechanism has a high probability of moving the inserted tee such that the height of the tee head is not uniform for each insertion, in effect negating the objective of the device to obtain a consistent tee height.

U.S. Pat. No. 3,671,037 (Murdock, Jr.) discloses a tee holder with a wedge-shaped slot that holds the tee head by sliding the tee head into the slot and also engages the tee body in a slot in the bottom foot of the device to minimize tipping of the tee as it is inserted. The problem with this device being the difficulty of sliding the device off of the tee that is inserted in the ground. An embodiment provides the device divided at the slots so the device may be opened and each half of the device removed from the tee. Either of these embodiments will require considerable time and the use of both hands to disengage the tee.

U.S. Pat. No. 3,333,848 (Budzinski) proposes a device shaped like a golf ball with a threaded hole that also has two thin, bent resilient members mounted on either side of the hole that in turn have holes in them at the part covering the threaded hole. The holes in the resilient members are offset so when the members are in the relaxed position, the sides of the holes will grip a golf tee body inserted in the holes. The resilient members must be bent sufficiently to allow insertion of the tee head through the holes in both members and into the threaded hole in the device. Once the tee is inserted in the ground, removal of the device requires bending the resilient members sufficiently to allow the tee head to pass through the holes in the members. This device appears to require considerable strength in the hand to bend the resilient members sufficient to insert the tee and to remove the device from the inserted tee. It also has a high probability of changing the height of the tee if the tee head catches on the edges of the holes in the resilient members due to the members not being bent sufficiently.

U.S. Pat. No. 3,074,719 (McKee) discloses a device that traps the tee head in a chamber by swinging shut a swinging portion of the device. Various embodiments of the device employ several configurations of swinging portions. All of the embodiments are small and fail to provide a comfortable way to grip the device to provide the insertion force necessary to insert the tee in hard ground. Each of them also appears to require the use of two hands to remove the device from the inserted tee.

U.S. Pat. No. 2,606,764 (Mason) shows another device that employs a multitude of springs to grip the tee head. This arrangement requires the ground friction against the tee body to overcome the spring tension against the head as in U.S. Pat. No. 3,671,037 (Murdock, Jr.). It is therefore subject to the same problems as that device.

U.S. Pat. No. 1,902,682 (Walrath) describes a tee-positioning device employing 2 tee-holding dogs that grip the tee head and are positioned in the slot of a sleeve. The dogs are released from the tee head by reaching the end of the slot that moves the dogs to the open position. The dogs move with the tee as it is forced into the ground by applying force to a long handle connected to a spring-loaded piston contained in the casing of the device. The dogs are locked in the open position by reaching a shoulder on a latch arm at the end of travel while inserting a tee. The dogs may then be put in the gripping position by inserting a tee and moving the latch arm to disengage them from the arm's shoulder. The complexity of the device appears to require a high manufacturing cost and the resulting device provides a loose grip on the tee that makes the tee prone to cocking in the device as force is applied to drive it into the ground. The complexity therefore provides a device that has a high probably of malfunction.

What is required is a compact, efficient, quick, and accurate tee setter that is positive in it's action of holding, setting, and releasing the golf tee in to the ground in preparation for the user to hit the ball with a club.

SUMMARY OF THE INVENTION

The present invention is a device for tee setting and a method of using this device to provide a tee set at a repeatable and desired distance above the ground. Setting the tee involves holding the tee in the device, inserting the tee into the ground at a predetermined and selected tee head height above the ground by exerting force with the heel of the hand, and release the golf tee, leaving the tee head at the predetermined selected height. In its simplest embodiment, the device consists of a main body with a tee-insertion opening in one end and an operating knob at the other end. There are multiple through-wall holes that serve as ball bearing raceways in the side of the main body, the raceways are arranged so a ball bearing inserted in the raceway on the outside surface of the body will extend into the tee chamber or cavity in the center of the body, but only a portion of the ball bearing surface will extend out of the raceway into the tee chamber. Each raceway contains a ball bearing, which is maintained in place by a tee hold-release sleeve surrounding the body. The body exterior and sleeve interior is arranged with flats and angles in a hexagon shape so when the body is inserted into the sleeve, the azimuthal orientation of the body relative to the sleeve is fixed and when the body is fully inserted in the sleeve the ball bearings are retained in the body ball bearing raceways by contact with the sleeve.

Two embodiments provide slightly different configurations for moving the body partially out of the sleeve and returning the body to the inserted position in the sleeve. In both, a concave-top operating knob is attached to the body knob attachment and a spring is arranged between the knob and the sleeve to apply tension to keep the body inserted in the sleeve. The concave surface on the knob is configured to fit a golf ball radius. Exerting force to move the knob downward while maintaining the sleeve position by gripping the sleeve will move the body downward relative to the sleeve and compress the spring. Releasing the force will allow the spring to move the body upward relative to the sleeve. In one embodiment, two opposing gripping concavities are arranged on both the sleeve and the body, the upper lip of the sleeve cavity is used to hold the sleeve while moving the body. In the second embodiment, only the tee hole-release sleeve contains the gripping cavity.

Motion of the body out of the sleeve allows motion of the ball bearings in the raceways. When the bearings are fully inserted in the raceways, their protrusion into the tee chamber allows them to contact the lower edge of a golf tee head, if the tee is fully inserted into the body. The body is configured with the end of the tee chamber in a convex shape to fit the concave head of a tee and the raceways are located so the fully inserted bearings will prevent the exit of a tee head if the tee is fully inserted in the body, holding the tee in the body. Moving the body out of the sleeve allows motion of the ball bearings away from the tee head, releasing the tee from the body.

The embodiments differ in how they allow the motion of the ball bearings. In one embodiment, the sleeve has a beveled wall through opening arranged from the outer surface to the hole inner surface. When the body is inserted in the sleeve, the beveled wall of the sleeve opening contacts the ball bearings to retain them in the body bearing raceway. Motion of the body out of the sleeve brings the sleeve opening beveled wall away from the ball bearings such that they may move from the body bearing raceway. The extent of motion of the body is limited and the slope of the sleeve hole is arranged so the ball bearings move sufficient to release the tee head but not far enough to entirely move out of the raceway, so the bearings continue to be retained in the raceway.

In the other embodiment, a body spacer washer is attached to the body outer surface with assembly screws. The washer contacts the ball bearings lower surface in the ball bearing raceways. The sleeve lower surface contacts the ball bearing upper surface when the body is inserted into the sleeve. The sleeve and the washer maintain the bearings fully inserted in the raceways. When the body is partially removed from the sleeve, the washer upper surface moves away from the sleeve lower surface forming an opening which allows the bearings to move in the raceway sufficient to release the tee head but not far enough to entirely move out of the raceway.

There are several variations on adjusting the tee height. All the variations adjust the device body tee chamber location with respect to the bottom of the device. This location determines the height of the tee head above the ground when the setting operation is completed.

One means of adjusting the tee chamber location is to provide a multiplicity of bases with varying distances between the upper and lower surfaces. One base of the desired size is selected and attached to the body to provide the desired distance between the base lower surface, which contacts the ground, and the tee chamber. Adjustment of the tee height is by changing the base on the body.

The other means of adjusting the tee chamber location is to provide an adjustment that changes the tee chamber location with respect to the bottom of the device. In one embodiment, the adjustment is a base with a height adjustment sleeve, a height adjustment insert, a height adjustment mechanism spring, and several assembly screws. The height adjustment sleeve has a flat surface on the tee insertion end and a central hole that permits insertion of a tee head into the device, the height adjustment insert installation end of the base has an insert opening with a flat surface and a spring retaining hole arranged to connect with the tee insertion end hole, the flat surface has a height adjustment groove around the circumference of the insert opening. The groove outer side forms the inner surface of the insert opening. The cylindrical side has multiple assembly screw installation through holes arranged between the side and the insert groove outer side. The inner side of the groove has threaded holes opposite the installation holes. An assembly screw may therefore be inserted through the installation through hole into the height adjustment groove and removably attached to the threaded hole.

The height adjustment insert upper end has an attachment hole that is used to attach the base to the device. The hole may be threaded or configured with a ball bearing attachment and is large enough to allow passage of the golf tee head. The lower end has a flat surface surrounded by the outer surface extension which projects from the flat surface and extends the upper end circumference in the downward direction. The extension has a helical groove extending from the helical extension portion outer surface through to the inner surface and extending around the circumference of the insert. The groove has a smooth contour upper surface and a corrugated contour lower surface.

The insert is arranged to fit within the height adjustment sleeve insert opening. When inserted it may be rotated with the extension rotating in the height adjustment groove. The sleeve assembly screw through holes allow installation of assembly screws through the helical groove. The screw heads then move in the insert helical groove when the sleeve is rotated relative to the insert such that the base thickness may be increased by rotation in one direction and decreased by rotation in the opposite direction.

A height adjustment mechanism spring is arranged in the sleeve spring retaining hole such that the spring provides an upward force on the insert so with the insert attached to the sleeve the spring force maintains contact of the helical groove corrugated surface with the assembly screw heads and the corrugation lower surface provides resistance to rotation of the sleeve relative to the insert as the screw head travels toward the corrugation ridge. This resistance retains the base thickness adjustment until the sleeve is rotated with sufficient force to overcome this resistance and then the base thickness is changed.

The other embodiment of the adjustment incorporates a height adjustment sleeve, a height adjustment top cap, a bottom base cover, a height adjustment sleeve cover, and a height adjustment mechanism spring in the device. The body of this embodiment is attached to a spacer washer that also is part of the mechanism to allow the motion of the ball bearings. The height adjustment sleeve is a cylinder containing attachment threads adjacent to the upper and lower ends and has a helical groove through the outer and inner surfaces. The groove is configured with a smooth contour upper surface and a corrugated contour lower surface and extends around the sleeve circumference from adjacent to the lower end threads to adjacent to the upper end threads. The device body spacer washer is sized to fit inside the sleeve.

The height adjustment top cap has an opening to allow the device hold-release sleeve to be inserted in the top cap, and then the cap may be attached to the height adjustment sleeve upper end threads. The bottom base cover has an opening sized to fit a golf tee head and it attaches to the height adjustment sleeve upper end threads. The height adjustment sleeve cover fits over the height adjustment sleeve and is contained between the top cap and bottom base.

The height adjustment spring is inserted in the height adjustment sleeve and fits between the top cap and the body spacer washer. The body spacer washer attachment screws are arranged such that the screw heads are contained within the height adjustment sleeve helical groove. The spring is compressed between the top cap and body spacer washer. The spring force maintains contact of the sleeve helical groove corrugated contour lower surface with the assembly screw head so the corrugation lower surface provides resistance to rotation of the sleeve relative to the body and hold-release sleeve as the screw head travels toward the corrugation ridge. This resistance retains the tee chamber location adjustment until the top cap, sleeve, bottom base cover and sleeve cover are rotated relative to the body and hold-release sleeve with sufficient force to overcome this resistance such that the tee chamber location is changed.

OBJECTS AND ADVANTAGES

One object of this invention is to provide a golf tee setting device that is simple, quick, and efficient in operation, which allows the user to manipulate the tee and golf ball with one hand.

A second object of this invention is to provide a golf tee setting device that provides a grip on the tee and a release of the tee.

A third object of this invention is to provide a golf tee setting device that provides a consistent tee height above the ground.

A fourth object of this invention is to provide a golf tee setting device that provides an easily adjustable tee height above the ground.

A fifth object of this invention is to provide a golf tee setting device that is easily stored and activated.

BRIEF DESCRIPTION OF THE SEVERAL VIEWS OF THE DRAWINGS

A more complete understanding of the present invention can be obtained by considering the detailed description in conjunction with the accompanying drawings, in which.

REFERENCE NUMERALS IN DRAWINGS

Figure 3:
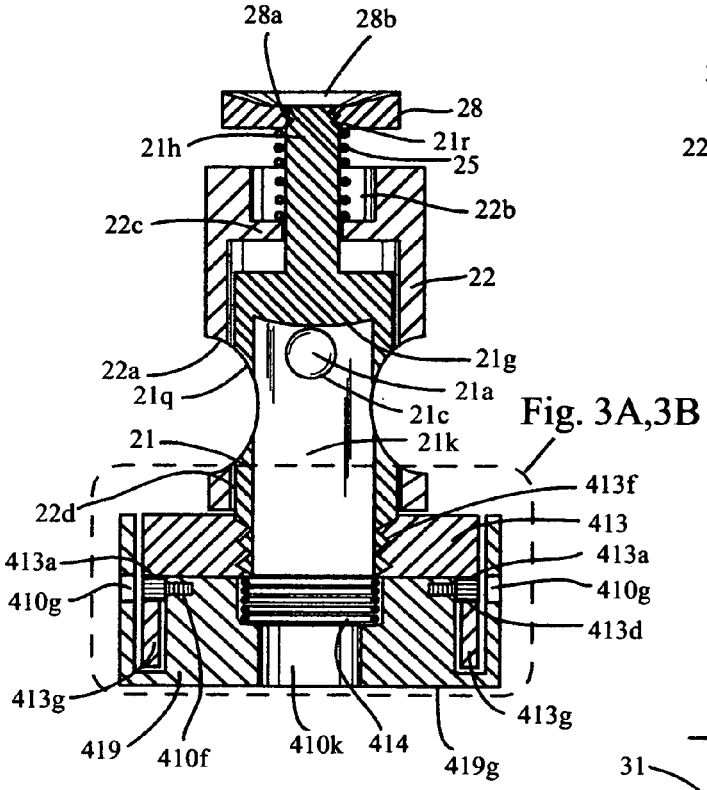
FIG. 3 shows a sectional view of the removable base embodiment of the adjustable golf tee precision setting device. This embodiment has the adjustable base attachment.

These reference numbers are used in the drawings to refer to areas or features of the invention.

Integral height adjustment embodiment of the adjustable golf tee precision setting device:

1 Main body
1A Ball bearings
1B Main body tee chamber outer surface
1C Raceways for the ball bearings
1D Attachment screws
1E Space washer and ball bearing retainer
1F Threaded hole
1G Convex top of the tee chamber
1H Shaft of main body
1 I Threaded hole for cap screw to attach the spacer washer
1 J Threaded hole for cap screw to attach the spacer washer
1K Tee chamber
1L Center hole in the spacer washer and ball bearing retainer
1M Beveled edge on the spacer washer
1L Corners of the hexagonal tee chamber housing
2 Tee hold-release sleeve
2A Gripping concavities
2B Enclosure for the spring
2C Spring enclosure bottom
2D Hold-release sleeve main body chamber
2E Hold-release sleeve main body chamber beveled entrance
2F Hold-release sleeve main body chamber angle
3 Height adjustment sleeve
3A Helical groove
3B Threaded top end for top cap
3C Threaded bottom end for base cap
4 Height adjustment spring
5 Tee hold-release mechanism spring
6 Height adjustment top cap
6A Thread to mate with the top of the height adjustment sleeve
6B Hole sized to allow the tee hold-release sleeve to moveably fit this opening
7 Operating knob
7A Operating knob attachment threads
7B Concave side of the operating knob
8 Height adjustment sleeve cover
9 Bottom base cover
9A Thread to mate with the 3C on the height adjustment sleeve
9B Hole to allow the top of a tee to enter the tee chamber in the main body Removable base embodiment of the of the adjustable golf tee precision setting device with the threaded base attachment:

21 Main body
21*a* 21*b* Ball bearings
21*c* Ball bearing raceway
21*g* Convex top of the tee chamber
21*h* Upper shaft of the main body
21*k* Tee chamber
21*n* Corners of the tee chamber housing
21*p* Threads on the lower end of the main body
21*q* Gripping concavities on the main body
21*r* Threaded top end of the upper shaft of the main body
22 Tee hold-release sleeve
22*a* Gripping concavities on the tee hold-release sleeve
22*b* Enclosure for the tee hold-release mechanism spring
22*c* Spring enclosure bottom
22*d* Sleeve main body opening
22*f* Sleeve main body opening angle
22*h* Ball bearing installation opening
22*j* Ball bearing beveled passage
25 Tee hold-release mechanism spring
28 Operating knob
28*a* Threaded center of the operating knob
28*b* Concave side of the operating knob
210 Threaded base
210*a* Threaded center hole of the base Removable base embodiment of the adjustable golf tee precision setting device with the ball bearing base attachment:

31 Main body
31*a* Ball bearing
31*c* Ball bearing raceway
31*n* Corners of the tee chamber housing
31*p* Attachment nipple
31*q* Gripping concavity on the main body
31*s* Attachment nipple groove
31*t* Shoulder stop for the cylindrical base extension
310 Ball bearing held type of base extension
310*a* Center cylindrical hole
310*d* Hole for containing the base extension holding mechanism
310*e* Ball bearing
310*f* Base extension holding mechanism spring
310*g* Retaining set screw Removable base embodiment of the adjustable golf tee precision setting device with the adjustable height base attachment:

410 Adjustable height base
410*g* Sleeve assembly screw installation through hole
410*k* tee insertion hole
413 Height adjustment insert
413*a* Helical groove
413*d* Assembly screw
413*f* Base attachment hole
413*g* Base outer surface extension
414 Height adjustment mechanism spring
419 Height adjustment sleeve
419*g* Base bottom

DETAILED DESCRIPTION OF THE INVENTION

Preferred Embodiment

This invention is an adjustable golf tee precision setting device. The device grips a standard golf tee, provides for holding the device in one hand with a golf ball used to apply force to the device to insert the tee into the ground, and provides for releasing the tee to leave it set into the ground at a desired and selected height of the tee above the ground. The device may also be operated without a golf ball, as the user prefers. Golf tees come in a typical configuration of a shaft and a head. The shaft has a point at the lower end, and often is tapered to increase in diameter towards the head. The head has a transitional steep slope on the lower part, an outer side, and a convex upper surface. The upper surface radius is set to allow placing a round golf ball on the tee head without it rolling off.

Figure 1:
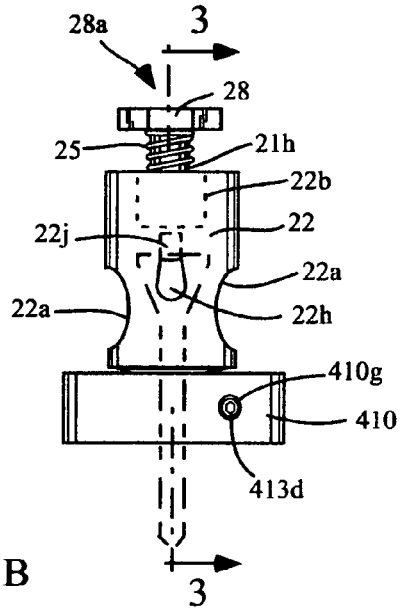
FIG. 1 shows a side view of the adjustable golf tee precision setting device. The embodiment shown has the adjustable height base attached. This figure also shows the location of the cross-section of FIG. 3.
Figure 2:
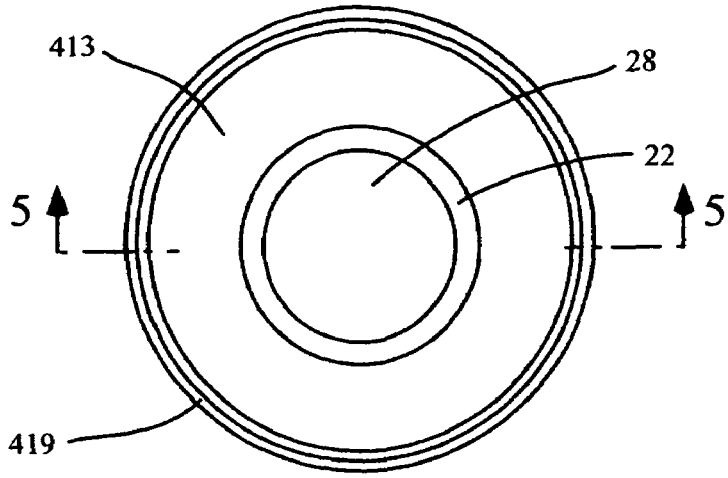
FIG. 2 shows a top view of the adjustable golf tee precision setting device. The embodiment shown has the adjustable height base attached.
Figure 7:
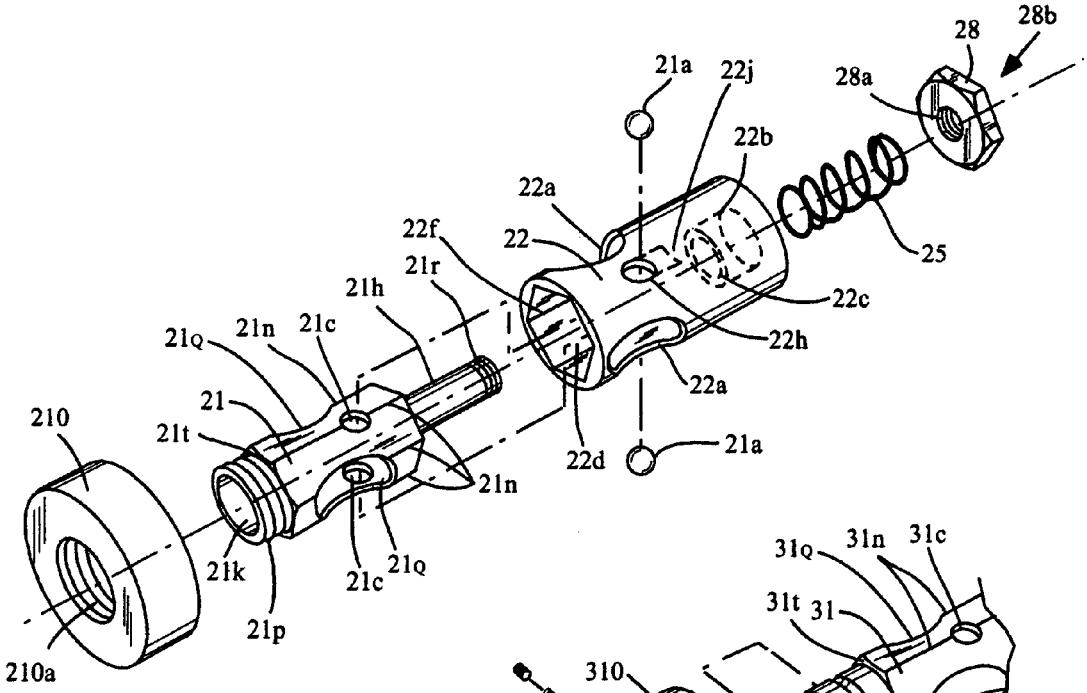
FIG. 7 shows an exploded view of the removable base embodiment of the adjustable golf tee precision setting device.

The adjustable golf tee precision setting device preferred embodiment is shown in FIGS. 1, 2, 3. The device external parts are a tee hold-release sleeve (22), an operating knob (28), a spring for the hold-release mechanism (25), and a base (410). The hold-release sleeve has gripping concavities (22*a*) on opposing sides that are grips to hold the device when setting a tee. The sleeve has an opening (22*h*) for installation of ball bearings used to grip the tee head. This opening is offset (22*j*) from the internal opening in the sleeve to provide for retention of the ball bearings. The sleeve upper end has a recess (22*b*) for retention of the spring (25). The adjustable height base (410) of the device has a sleeve (419) and an insert (413) as shown in FIGS. 2, 3, and 7B.

Figure 6A:
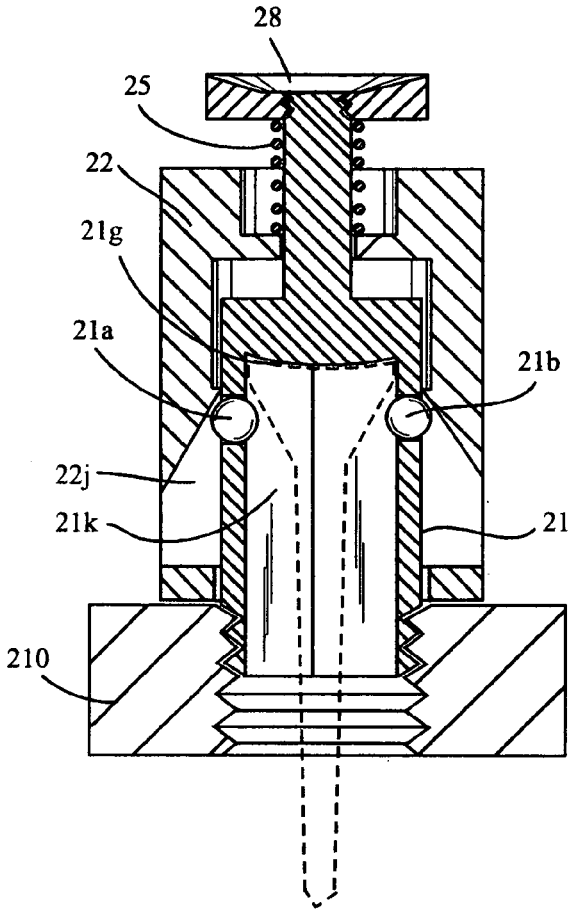
FIG. 6A shows a cross section view of the removable base embodiment of the adjustable golf tee precision setting device illustrating retaining a golf tee in the tee chamber.

FIG. 3 shows the internal parts of the device, the main body (21) and the ball bearing (21*a*), and their relationship to the externally visible parts. FIG. 7 shows further details of the individual parts. The main body has an opening at the bottom for entry of the tee into the round tee chamber (21*k*). The body lower end is threaded (21*p*) for attachment of the base. The tee chamber has a convex end surface to align with the concave top of a golf tee head. The tee head is gripped between the convex surface and the ball bearing (21*a*) as shown in FIG. 6A. The ball bearing is retained in the ball bearing raceway (21*c*) as the raceway opening is smaller in diameter than the bearing. The body outer surface has 2 opposing concavities (21*q*) that align with the concavities (22*a*) on the sleeve. The upper part of the body has a shaft (21*h*) that extends through an opening in the bottom of the sleeve spring enclosure (22*c*). The shaft is threaded for attachment of the operating knob (28). The operating knob is concave (28*b*) on top to allow fitting a golf ball on the knob. The bottom of the knob is a seat (21*r*) for the spring (25). The sleeve (22) has an opening (22*d*) to enclose the body, as shown in FIG. 7B. The body is inserted in the sleeve with the sleeve concavities (22*a*) aligned with the body concavities (21*q*). This also aligns the sleeve ball bearing beveled passage (22*j*), shown in FIGS. 1, 6A and 6B, with the body ball bearing raceway (21*c*) shown in FIG. 3 when the body is inserted in the sleeve. The ball bearings are assembled through the installation openings (22*h*) as the body is inserted in the sleeve. The force of the spring (25) then maintains the body inserted in the sleeve.

Figure 6B:
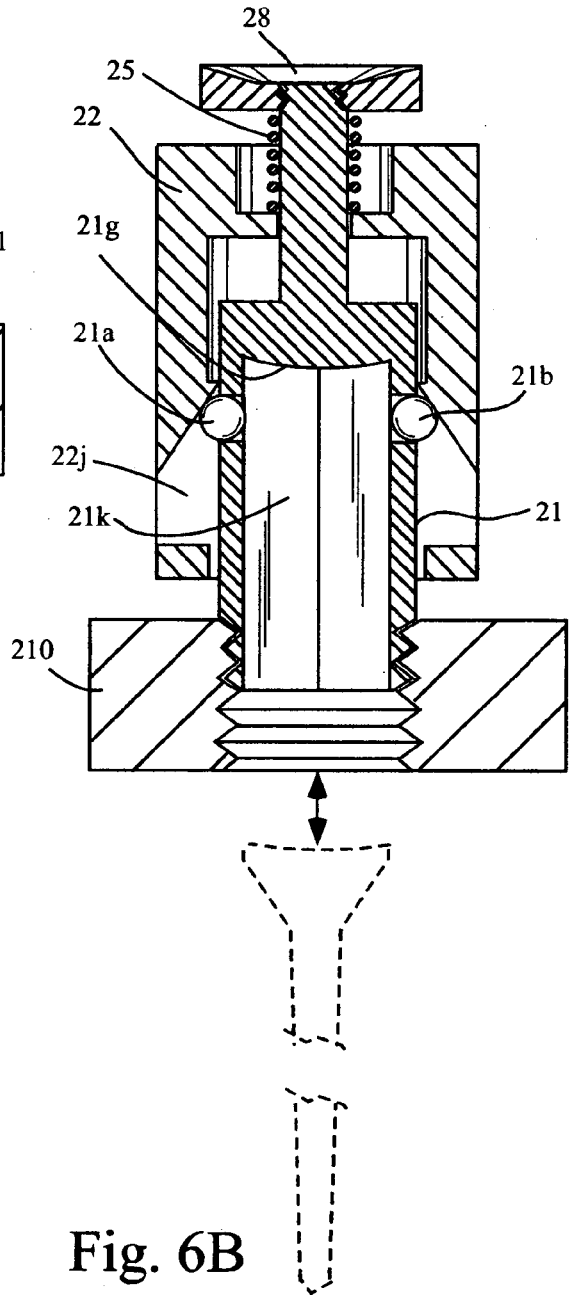
FIG. 6B shows a cross section view of the removable base embodiment of the adjustable golf tee precision setting device illustrating releasing a golf tee from the tee chamber or inserting a golf tee in the tee chamber.

Retention of a tee in the tee chamber (21*k*) and release of a retained tee is illustrated in FIGS. 6A and 6B. The ball bearings (21*b*) are retained in the main body (21) raceways by a reduced diameter of the raceways compared to the ball bearing, and by contact with the tee hold-release sleeve (22) ball bearing beveled passage (22*j*), forcing the ball bearings as fully into the raceways as they can go. In inserting a tee, sufficient force is applied to the operating knob (28), moving it relative to the sleeve (22), which compresses the spring (25) and causes the body to move partially out of the sleeve. This provides a gap between these parts and allows the ball bearings (21*a*, 21*b*) to move from being fully inserted in the raceway, as shown in FIG. 6A, to being partially inserted in the raceway as shown in FIG. 6B. A tee may then be inserted in the tee chamber (21*k*) and then the force removed from the operating knob. The spring force returns the body to the fully inserted position in the sleeve as shown in FIG. 6A. When fully inserted, the body moves the ball bearings fully into the raceway. The ball bearing surfaces then contact the slope on the lower part of the tee head, placing the top of the tee head in contact with the convex top of the tee chamber (21*g*). Release of the tee is by again applying the force to the operating knob. This again provides a gap between the body and sleeve and allows the ball bearings (21*a*, 21*b*) to move from being fully inserted in the raceway, as shown in FIG. 6A, to being partially inserted in the raceway as shown in FIG. 6B.

Figure 4:
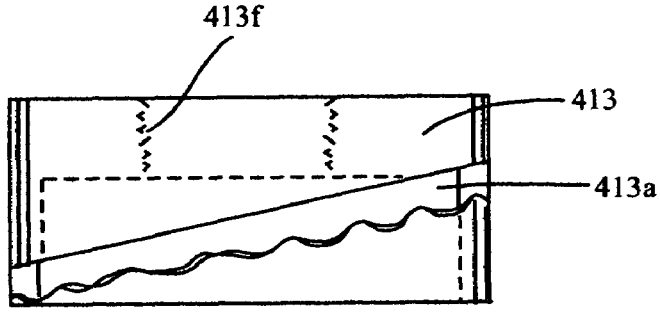
FIG. 4 shows a side view of the adjustable base for use on the adjustable golf tee precision setting device.
Figure 5:
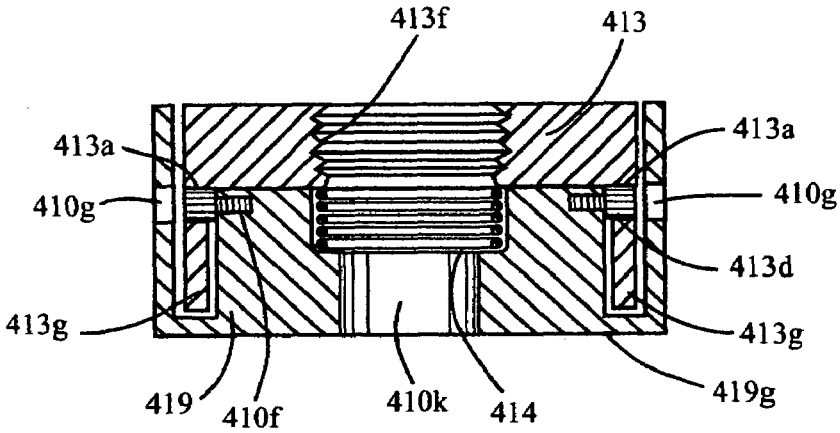
FIG. 5 shows a sectional view at the centerline of the adjustable base.

The base for the preferred embodiment is adjustable. FIG. 3 shows a sectional view of the base, FIG. 2 shows a top view, FIG. 4 shows a side view, and FIG. 7B shows an exploded view. The base adjustment changes the distance between the top of the base and bottom (lower surface) of the base, which is also the bottom of the device. The bottom of the base is the part of the device that contacts the ground when setting a tee. When the tee is retained in the device, as shown in FIG. 6A, the top of the tee head is touching the convex top of the tee chamber. The distance from the top of the tee chamber to the bottom of the device is the height above the ground a tee will be when set by the device. Changing this distance is the adjustment of the tee-setting device that will adjust this height.

The adjustable base as shown in FIG. 3 has a height adjustment insert (413), a height adjustment mechanism spring (414) and a height adjustment sleeve (419) attached to the insert by assembly screws (413*d*). The insert is cylindrical with the upper end a solid flat surface except for a threaded base attachment hole (413*f*). The lower end is a hollow cylinder, the outer surface extension (413*g*) extending the outer surface of the insert in the downward direction. This extension has a helical groove (413*a*), shown in FIGS. 3 and 4, that extends through the extension to the interior of the hollow cylinder. The groove is around the circumference of the cylinder, its distance from the insert bottom increasing from one end of the groove to the other. The groove has a smooth contour upper surface and a corrugated contour lower surface as shown in FIG. 4. The term corrugated is intended to mean something formed into alternating ridges and grooves.

The adjustable base sleeve (419) top end is the height adjustment insertion end and the bottom is the tee insertion end. The height adjustment end is a hollow cylinder terminating in a groove that is configured so the insert outer surface extension fits within the groove. The inner side of the groove terminates in a round, central flat surface with a spring retaining hole that connects with a tee insertion hole (410K) in the tee insertion end. The spring retaining hole is larger in diameter than the tee insertion hole to provide a seat for the spring. The outer side of the groove has several assembly screw installation through holes and the inner side of the groove has threaded holes opposite (aligned with) the assembly screw installation through holes so the assembly screws may be installed through the cylindrical side of the sleeve as shown in FIGS. 1, 3, and 7B.

The adjustable base insert (413) is installed in the adjustable base sleeve (419) with the height adjustment mechanism spring (414) in the spring retaining hole. The spring provides tension against the bottom of the insert tending to lift the insert. The insert is attached to the sleeve using assembly screws (413*d*) with extended heads as shown in FIG. 3. The screws are installed through the assembly screw installation through holes in the cylindrical side of the sleeve and pass through the helical groove (413*a*) in the insert. FIG. 3 shows the screws installed with the insert helical groove in the position providing the smallest distance from the top of the insert to the bottom of the base sleeve.

The height adjustment mechanism spring (414) provides an upward force on the insert (413) that maintains contact of the helical groove corrugated surface with the assembly screw heads. This force provides resistance to turning of the sleeve relative to the insert as additional force to overcome the spring force is needed to move the assembly screw heads along the grooves of the helical groove lower surface to a ridge, where the next groove may be entered. Overcoming the spring force and turning the sleeve moves the screw heads along the corrugated surface of the helical groove in the insert. Since the groove distance from the insert bottom increases from one end of the groove to the other, turning the sleeve relative to the insert moves the assembly screw heads along the groove, increasing the thickness of the base by turning in one direction, that is increasing the distance from the upper end of the insert to the sleeve bottom, and decreasing the thickness of the base by turning in the opposite direction. The upper end of the insert is attached to the device body as shown in FIG. 3, therefore changing the thickness of the base changes the distance from the top of the tee chamber to the bottom of the device.

Additional Embodiments

Figure 7A:
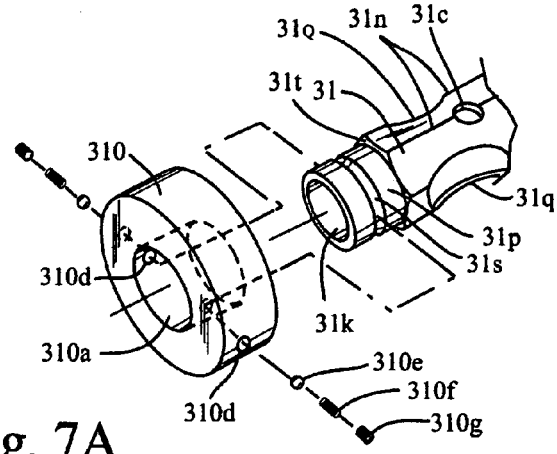
FIG. 7A shows an exploded view of the removable base embodiment of the adjustable golf tee precision setting device in an embodiment with a ball bearing base attachment.
Figure 7B:
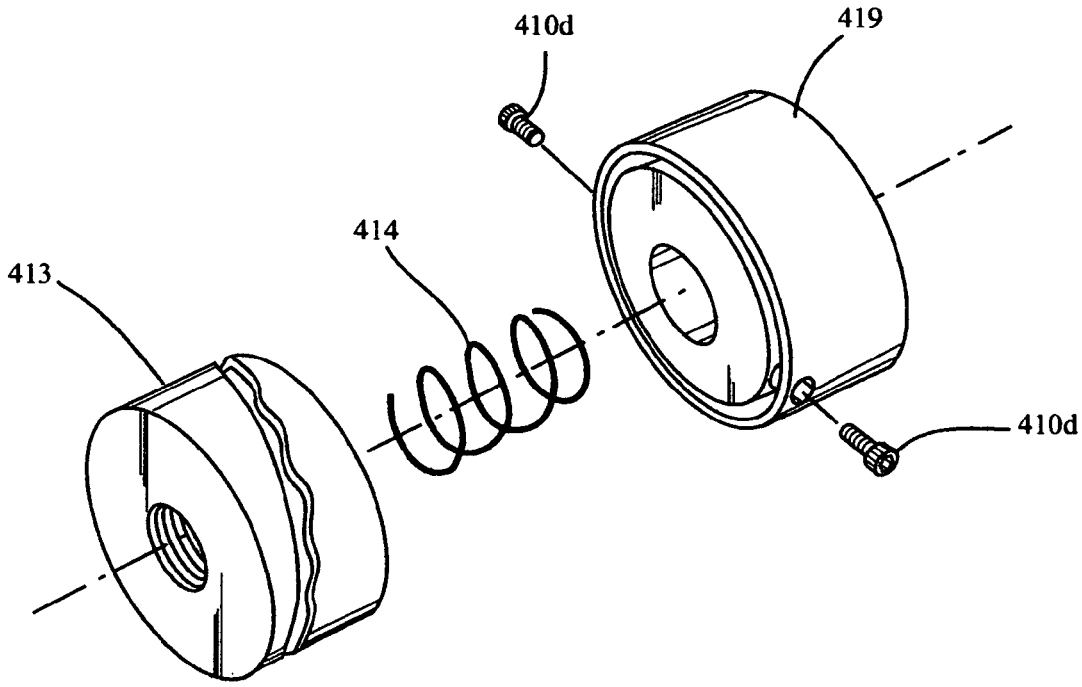
FIG. 7B shows an exploded view of the adjustable base for use on an embodiment of the removable base embodiment of the adjustable golf tee precision setting device.

FIGS. 7, 7A and 7B show an exploded view of several embodiments of the adjustable golf tee precision setting device. The embodiment shown in FIG. 7 is the device with a solid base (210) which has threads (210*a*) for attachment to the main body (21). The other parts of this device are the same as the preferred embodiment. Solid bases of differing thickness, that is distance between the upper and lower surfaces, can be used to provide adjustment of the tee chamber location (the distance between the top of the tee chamber and the bottom of the device) by changing the base. The preferred embodiment is the combination of FIG. 7 and substituting the base of FIG. 7B for the solid base shown in FIG. 7.

Figure 3A:
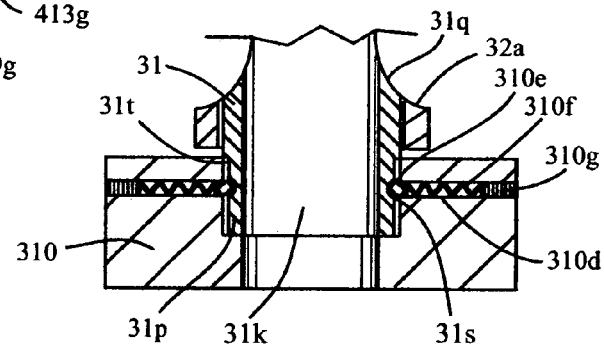
FIG. 3A shows a sectional view of the removable base embodiment of the adjustable golf tee precision setting device in an embodiment with a ball bearing base attachment.
Figure 3B:
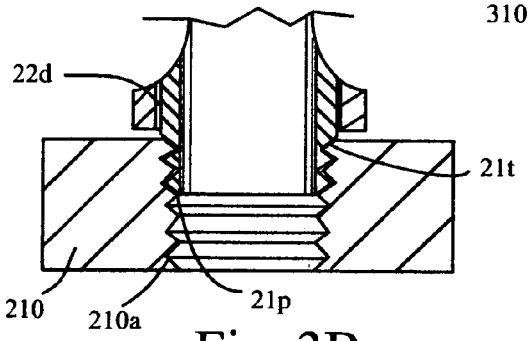
FIG. 3B shows a sectional view of the removable base embodiment of the adjustable golf tee precision setting device in an embodiment with a fixed thickness threaded base attachment.

FIGS. 3A and 7A shows an embodiment of the adjustable golf tee precision setting device employing a ball bearing attachment of the base to the main body (310). In this embodiment, spring loaded (310*f*) ball bearings (310*e*) protrude into the attachment hole (310*a*) in the base and the springs are retained by set screws (310*g*). The main body for this embodiment differs in that the lower part has a groove (31*s*) in the attachment nipple (31*p*). The base is attached to the body by pressing the base on the attachment nipple until the spring force on the ball bearings is overcome so the bearings move into their hole and the base may be slid on the nipple until spring force moves the ball bearings into the groove in the nipple. The ball bearings in the groove maintain the base on the nipple until sufficient force is applied to the base to overcome the spring force on the ball bearings and they again move into their hole to allow the base to be removed.

Figure 8:
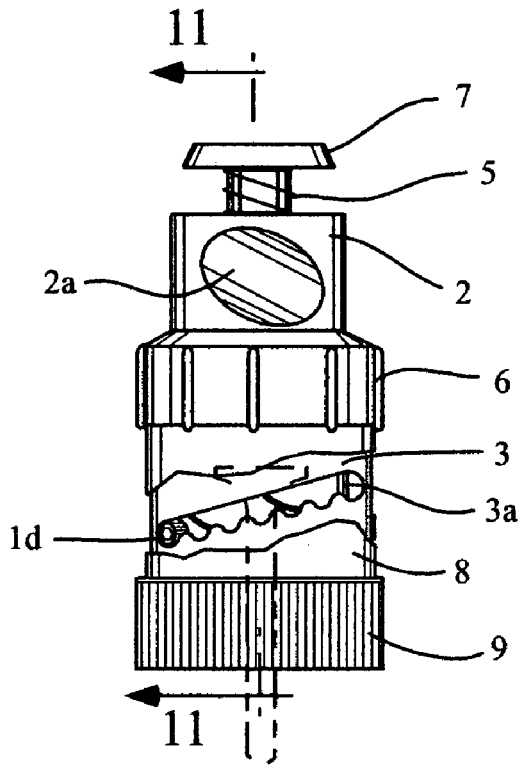
FIG. 8 shows a side view of the integral height adjustment embodiment of the adjustable golf tee precision setting device and also shows the location of the sectional side view of FIG. 5. This figure also shows the height adjustment sleeve cover cut away to show the helical groove in the height adjustment sleeve.

An embodiment of the adjustable golf tee precision setting device with an integral height adjustment is shown in FIGS. 8, 9, 10, 11, and 12. FIG. 8 shows a side view of the exterior with a cut-away showing the helical groove in the height adjustment sleeve. The device has the gripping concavities (2A) on the upper portion of the height adjustment sleeve (2). The height adjustment sleeve cover (8) is cut-away to show the height adjustment sleeve (3) containing the helical groove (3A) and the head of a cap screw (ID) in the groove. A height adjustment top cap (6) and bottom base cover (9) are also externally visible parts.

Figure 9:
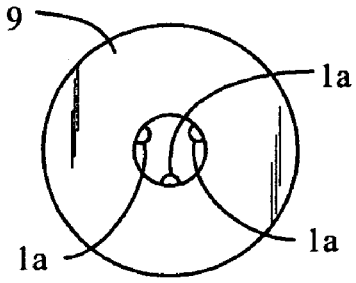
FIG. 9 shows a bottom view of the integral height adjustment embodiment of the adjustable golf tee precision setting device.
Figure 10:
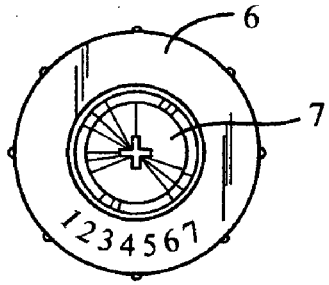
FIG. 10 shows a top view of the integral height adjustment embodiment of the adjustable golf tee precision setting device.

FIG. 9 is a bottom view of the integral height adjustment embodiment showing the bottom base cover (9). This shows the hole in the cover the tee is inserted into for retention in the device, and the ball bearings (1A) that retain the tee. FIG. 10 is a top view showing the top cap (6) and the operating knob (7).

Figure 11:
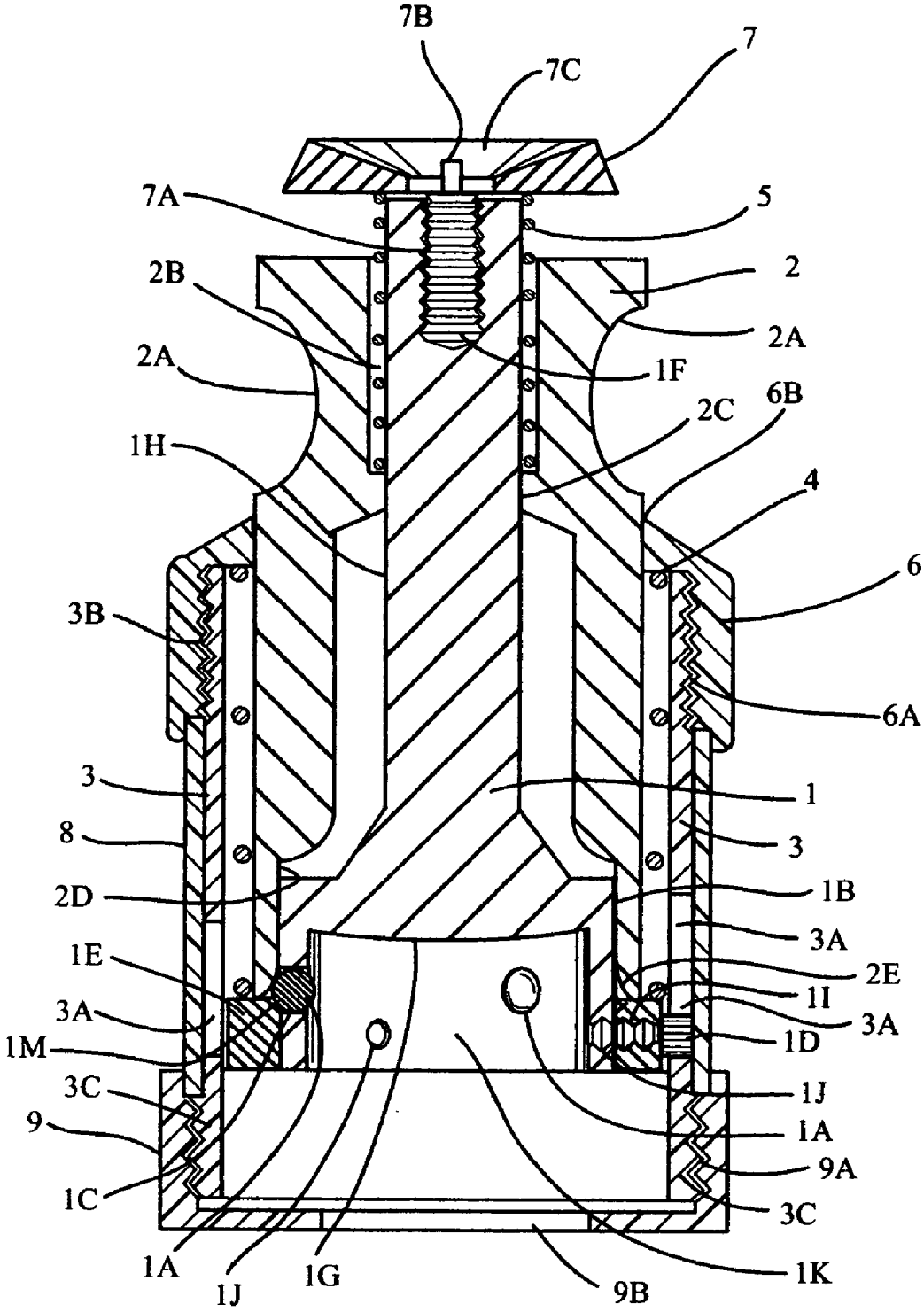
FIG. 11 shows a sectional view of the integral height adjustment embodiment of the adjustable golf tee precision setting device. The cut-away is at the center as shown in FIG. 8.
Figures 8, 12:
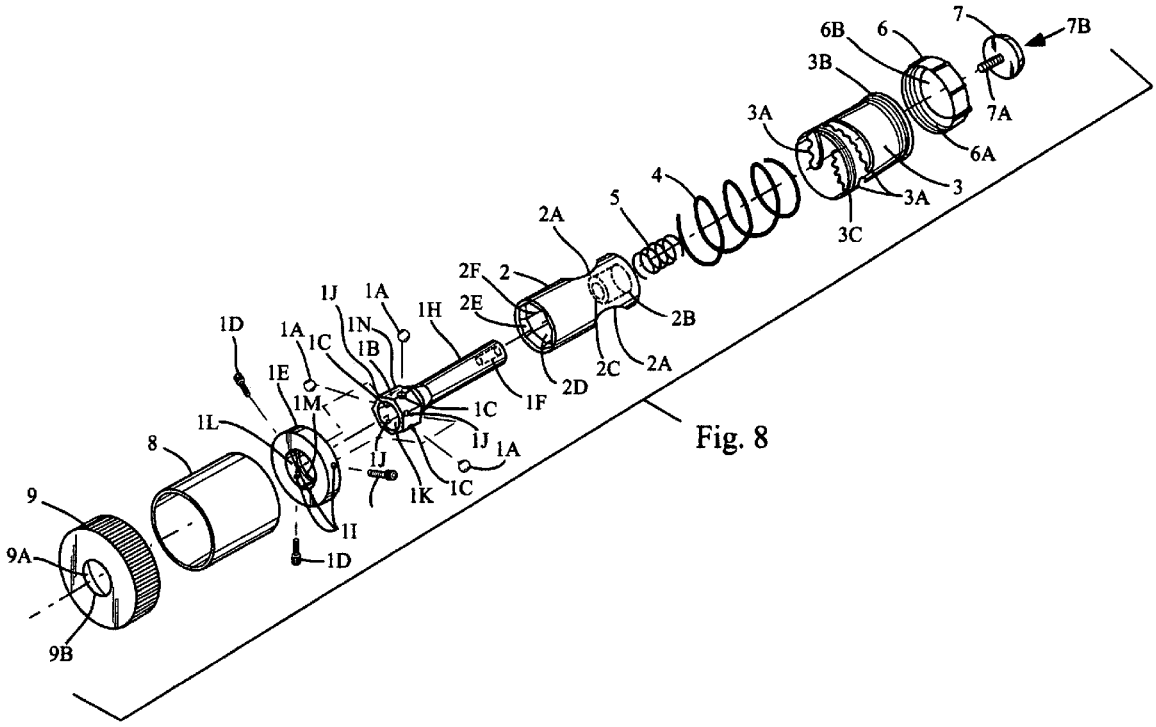
FIG. 12 shows an exploded view of the of the integral height adjustment embodiment of the adjustable golf tee precision setting device. The parts assembled are shown in FIG. 8 as indicated on this figure.

FIG. 11 is a sectional view of the adjustable golf tee precision setting device showing the major parts, the main body (1), the tee hold-release sleeve (2), the height adjustment sleeve (3), the height adjustment spring (4), the spring (5) for the body motion, the top cap (6), the operating knob (7), the height adjustment sleeve cover (8), and the bottom base cover (9). The section location is shown on FIG. 8. FIG. 12 is an exploded view of the integral height adjustment embodiment.

The gripping concavity (2A) is on the tee hold-release sleeve (2). When the main body (1) is fully inserted in the tee hold-release sleeve (2), the ball bearings (1A) are retained in the main body raceways by a reduced diameter of the raceways compared to the ball bearing, and by contact with the sleeve and a body spacer washer (1E) mounted on the outer surface of the body with attachment screws (1D) forcing the ball bearings as fully into the raceways as they can go. The ball bearings thus protrude into the tee chamber a portion of their diameter sufficient to retain a tee in the tee chamber. The body is inserted in the tee hold-release sleeve body chamber (2D) with its shaft (1H) extending up through an opening in the tee hold-release sleeve spring enclosure bottom. Applying sufficient force to the operating knob moves the body partially out of the tee hold-release sleeve, which moves the body spacer washer (1E) that is attached to the body away from the bottom of the tee hold-release sleeve (2). This provides a gap between these parts and provides space for the ball bearings (1A) to move in the out direction from the raceways (1C) in the body into the bevel in the sleeve (2E). If a tee is retained in the body tee chamber (1K), this gap allows movement of the ball bearings sufficient to release the tee. Releasing the force on the operating knob allows the spring (5) to fully insert the body in the tee hold-release sleeve body chamber and return the ball bearings fully into the raceway.

Adjustment of the tee chamber location with respect to the device bottom uses a height adjustment sleeve (3), a height adjustment top cap (6), a bottom base cover (9), a height adjustment sleeve cover (8), and a height adjustment spring (4) in conjunction with the body spacer washer attachment screws. The sleeve (3) contains a helical groove (3A) that extends through to the sleeve interior as shown in FIG. 12. The groove is around the circumference of the sleeve, its distance from the sleeve bottom increasing from one end of the groove to the other. The groove has a smooth contour upper surface and a corrugated contour lower surface as shown in FIGS. 8 and 12. The sleeve (3) fits around the hold-release sleeve (2) and the main body spacer washer (1E). The upper end and the lower end have external threads for attachment of the top cap (6) and the bottom base cover (9), which have mating internal threads. The sleeve is located around the main body and the main body spacer washer as shown in FIG. 11. The heads of the attachment screws (1D) for attaching the washer to the body are located in the height adjustment sleeve helical groove (3A). The height adjustment sleeve cover (8) is around the sleeve and the height adjustment spring (4) is in the annulus between the hold-release sleeve (2) and the height adjustment sleeve (3). The main body spacer washer upper surface is the lower seat for the height adjustment spring. The top cap (6) is attached to the upper portion of the height adjustment sleeve and provides an upper seat for the height adjustment spring and the height adjustment sleeve cover. The top cap also has a central through opening to allow sliding the cap around the height adjustment sleeve. The bottom base cover (9) is attached to the lower end of the height adjustment sleeve, and is the lower seat for the height adjustment sleeve cover (8).

The height adjustment spring (4) is compressed between the top cap and body spacer washer as shown in FIG. 3, the spring force acting on the top cap, which is attached to the height adjustment sleeve, maintains contact of the sleeve helical groove corrugated lower surface with the assembly screw head. The corrugated groove lower surface provides resistance to rotation of the assembly of the top cap, sleeve, bottom base cover and sleeve cover relative to the body and hold-release sleeve as additional force to overcome the spring force is needed to move the assembly screw heads along the groves of the corrugated surface to a ridge, where the next groove may be entered. This resistance retains the tee chamber location adjustment until the sleeve is rotated with sufficient force to overcome this resistance. Since the groove distance from the device bottom increases from one end of the groove to the other, turning the top cap rotates the height adjustment sleeve relative to the tee hold-release sleeve and main body. This moves the screws heads along the groove, increasing the distance of the tee chamber from the device bottom by turning in one direction, and decreasing the distance by turning in the opposite direction.

Operation

The adjustable golf tee precision setting device is operated on a golf course or driving range by first adjusting the tee-setting device to the desired tee head height above the ground. This is accomplished by either installing a base that provides the desired tee head height above the ground, or by adjusting the device to the desired height. The embodiments that adjust require applying enough turning force to the device to overcome the height adjustment spring tension and turning the adjustment to the desired setting.

Figure 13:
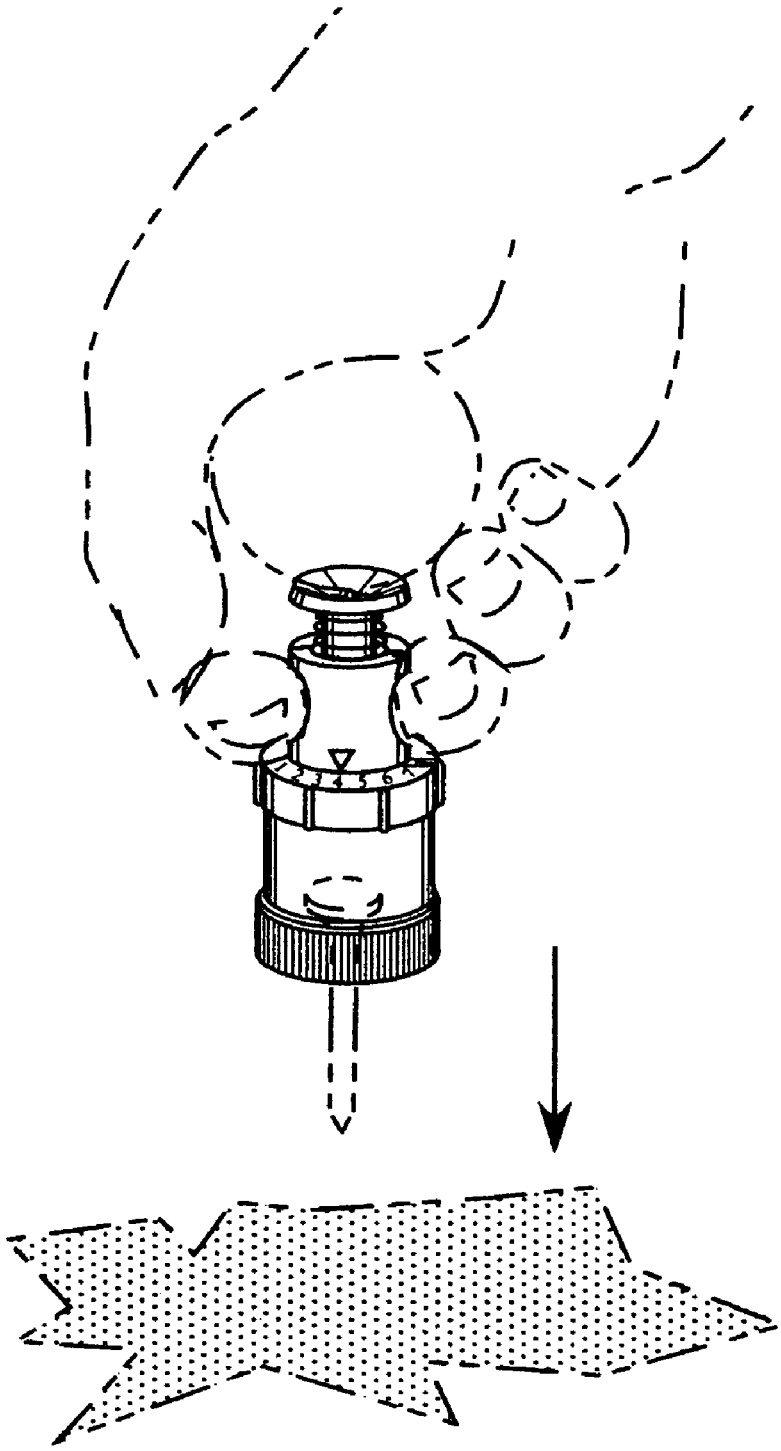
FIG. 13 shows an isometric view of the adjustable golf tee precision setting device with a golf tee inserted in the device and a user's hand gripping the device with 2 fingers and the heel of the hand ready to insert the tee into the ground using force from the heel of the hand. The device is in the configuration to retain the tee.

A golf tee is then inserted in the device by placing a golf ball on the concave surface of the operating knob and holding the device between two fingers and the golf ball in the palm of the hand, exerting a force on the operating knob, depressing the knob toward the device. The tee is inserted in the opening on the bottom of the device until it touches the end of the tee chamber. The force on the operating knob exerted by the palm of the hand and the fingers is then removed and the device will hold the tee by the head. FIG. 13 shows the device holding a tee using 2 fingers on the device and the golf ball cradled in the heel of the hand using downward force to insert the tee into the ground. The heel of the hand is the fleshy rounded base of the palm as shown against the golf ball in FIG. 13.

Figure 14:
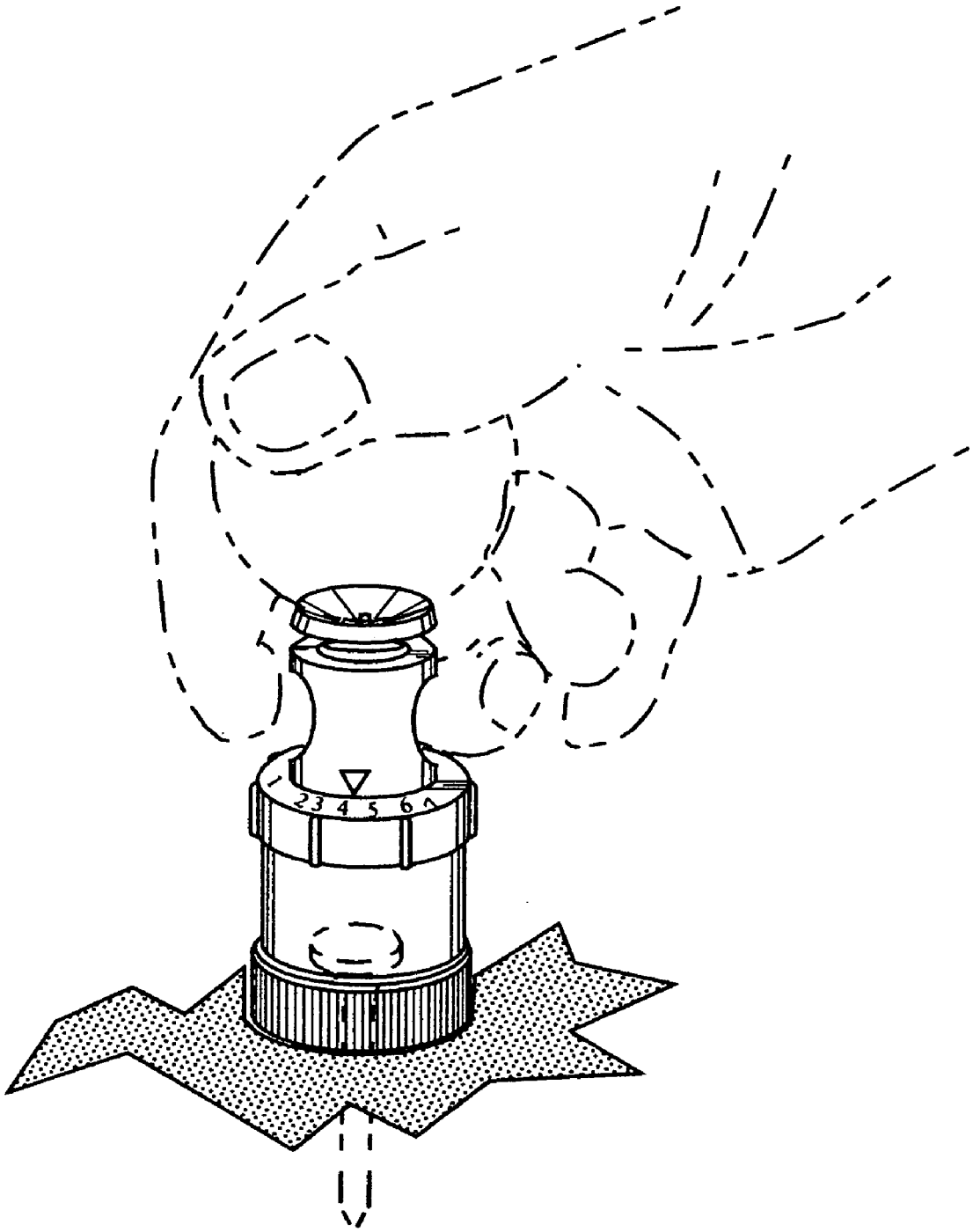
FIG. 14 shows an isometric view of the adjustable golf tee precision setting device after inserting a golf tee into the ground. The user's hand is gripping the device using 2 fingers and the palm of the hand. The device is in the configuration to release the tee.

The tee is then inserted in the ground by applying force with the heel of the hand on the golf ball until the device bottom touches the ground. A force is applied to the operating knob using the fingers and the palm of the hand and the device is lifted up, releasing the tee and leaving the tee at a precisely set depth. FIG. 14 shows the device in position to release the inserted tee.

Some users may prefer to operate the device without a golf ball. The grip on the device may then be varied to apply force to the operating knob with the thumb, or palm of the hand. Some users may also prefer to use 2 hands.

I claim:

1. A golf tee setting device with a bottom, a tip and a side of generally circular shape comprising:

a. a golf tee chamber opening arranged in the bottom of the device;

b. means for retaining the golf tee head in the device is a convex tee chamber upper surface and a multitude of ball bearing surfaces penetrating into the tee chamber such that the golf tee head is retained in the device;

c. means for selecting a tee head height above the ground for the golf tee to be inserted;

d. means for fitting a golf ball to the device;

e. means for gripping the device with the golf ball in the heel of the hand such that force may be applied to the golf tee; and f. means for releasing the golf tee from the device.

2. The golf tee setting device of claim 1 further comprising the means for selecting a tee head height above the ground for the golf tee to be inserted is a multitude of bases of differing thickness, one of which is selected to provide the desired tee chamber location above the device bottom.

3. The golf tee setting device of claim 1 further comprising the means for selecting a tee head height above the ground for the golf tee to be inserted is means for adjusting the tee chamber location distance from the device bottom.

4. The golf tee setting device of claim 1 further comprising the means for fitting a golf ball to the device is a concave top surface.

5. The golf tee setting device of claim 4 further comprising the means for gripping the device with the golf ball in the heel of the hand is opposing concavities in the device side wherein two fingers exert force on the device to press the golf ball into the heel of the hand.

6. The golf tee setting device of claim 5 further comprising the means for releasing the golf tee from the device is a means for moving the ball bearing surfaces from the tee chamber.

7. The golf tee setting device of claim 6 further comprising the means for moving the ball bearing surfaces from the tee chamber is operated by exerting force on the device with two fingers and exerting force on a golf ball fitted to the device by exerting force on the golf ball with the palm of the hand.

8. A golf tee-setting device to hold, insert into the ground until the device bottom contacts the ground, and release the golf tee, leaving the tee at a predetermined selected height comprising:

a. A main body configured with an outer surface, a tee-insertion end, an operating knob attachment end, and a multiplicity of through-wall ball bearing raceways, the tee-insertion end with an opening to a tee chamber arranged such that a tee may be inserted in the body tee chamber, the operating knob attachment end arranged such that an operating knob may be attached to the body, the ball bearing raceways arranged such that a ball bearing inserted in the raceway on the outside surface of the body, and contacting the raceway walls will extend into the body tee-insertion end opening;

b. a multiplicity of ball bearings arranged in the ball bearing raceways;

c. a tee hold-release sleeve with an outer surface, a lower surface, a bottom hole, a bottom hole internal surface, and ball bearing retention means, the bottom hole arranged such that the body may be slidably inserted into the sleeve, the ball bearings retained in the body ball bearing raceways by contact with the sleeve when the body is fully inserted in the sleeve;

d. means for moving the body partially out of the sleeve and means for returning the body to the fully inserted position in the sleeve;

e. means for motion of the ball bearings when the body is partially removed from the sleeve such that a tee head inserted into the tee chamber will contact and be retained in the hole by the ball bearings with the body fully inserted and will disconnect from the ball bearings when the body is partially out of the sleeve; and f. means for adjusting the tee chamber location above the device bottom arranged such that a tee inserted into and retained in the body will extend from the device a predetermined adjustable distance wherein the tee may be inserted into the ground, the body moved partially out of the sleeve, disconnecting the device from the tee, and the device removed leaving the tee head the predetermined and selected distance from the ground.

9. The golf tee-setting device to hold, insert into the ground at a predetermined and selected tee head height above the ground, and release the golf tee, leaving the tee at the predetermined selected height as in claim 8 further comprising the means for moving the body partially out of the sleeve and means for returning the body to the fully inserted position in the sleeve is comprised of two opposing gripping concavities arranged on the sleeve and body, a beveled nut and spring retainer knob removably attached to the body knob attachment end and a spring arranged between the knob and the sleeve, the knob arranged such that a golf ball may be fit to the beveled nut and spring retainer such that the golf ball is held in the palm of the hand with the tee-setting device held by the gripping concavities with two fingers of the same hand wherein the fingers apply force to the sleeve while the palm of the hand applies force to the body moving the body out of the sleeve and compressing the spring, and the spring returns the body to the fully inserted position when the finger and hand pressure is released.

10. The golf tee-setting device to hold, insert into the ground at a predetermined and selected tee head height above the ground, and release the golf tee, leaving the tee at the predetermined selected height as in claim 9 further comprising the means for motion of the ball bearings when the body is partially removed from the sleeve is comprised of a beveled wall through opening in the sleeve arranged from the outer surface to the hole inner surface such that when the body is fully inserted in the sleeve, the beveled wall of the opening contacts the ball bearings to retain them in the body bearing raceway, and the motion of the body out of the sleeve brings the sleeve opening beveled wall away from the ball bearings such that they may move in the body bearing raceway.

11. The golf tee-setting device to hold, insert into the ground at a predetermined and selected tee head height above the ground, and release the golf tee, leaving the tee at the predetermined selected height as in claim 10 further comprising the means for adjusting the tee chamber location is comprised of a multiplicity of bases each with an upper surface and a lower surface and each with different distances between the upper and lower surfaces, one base selected and removably attached to the body such that a tee inserted into and retained in the body will extend from the base lower surface the selected predetermined adjustable distance determined by the distance between the base upper and lower surfaces of the selected base wherein the tee may be inserted into the ground and the device removed leaving the tee head the predetermined and selected distance from the ground.

12. The golf tee-setting device to hold, insert into the ground at a predetermined and selected tee head height above the ground, and release the golf tee, leaving the tee at the predetermined selected height as in claim 10 further comprising:

a. the means for adjusting the tee chamber location is an adjustable base comprising a height adjustment sleeve, a height adjustment insert, a height adjustment mechanism spring, and a multiplicity of assembly screws with a head portion and a threaded portion;

b. the height adjustment sleeve with a tee insertion end, a height adjustment insert installation end, and a cylindrical side, the tee insertion end arranged as a hollow cylinder with an outer surface and an inner surface and a central flat surface projection containing a spring retaining hole arranged to connect with the tee insertion end hole, the circumference of the flat surface forming a height adjustment groove around the circumference of the insert opening with an inner side and an outer side, the groove outer side with a multiplicity of assembly screw installation through holes arranged between the cylindrical sleeve side and the groove outer side, and the groove inner side with threaded holes arranged opposite the installation holes, wherein an assembly screw may be inserted into the groove through the installation through hole and removably attached to the threaded hole;

c. the height adjustment insert having an upper end, a lower end, a cylindrical outer surface and an outer surface extension extending in the downward direction from the cylindrical outer surface, and with a helical groove in the outer surface extension, the insert arranged such that it may be removably and rotatably inserted into the height adjustment sleeve wherein the insert is contained within the height adjustment sleeve insert opening;

d. the helical groove in the insert cylindrical side surface arranged with a smooth contour upper surface and a corrugated contour lower surface, the groove extending from the helical extension portion outer surface through to the inner surface and arranged such that the insert may be removably attached to the sleeve by the assembly screws, the screw heads arranged such that the sleeve may be rotated relative to the insert wherein the screw heads move in the insert helical groove such that the base thickness may be increased by rotation in one direction and decreased by rotation in the opposite direction; and e. the height adjustment mechanism spring arranged such that a tee head may pass through the center of the spring and arranged in the sleeve spring retaining hole such that the spring provides an upward force on the insert such that the spring force maintains contact of the helical groove corrugated surface with the assembly screw heads and the corrugation groove lower surface provides resistance to rotation of the sleeve relative to the insert wherein the resistance retains the base thickness adjustment until the sleeve is rotated with sufficient force to overcome this resistance and the base thickness is changed.

13. The golf tee-setting device to hold, insert into the ground at a predetermined and selected tee head height above the ground, and release the golf tee, leaving the tee at the predetermined selected height as in claim 8 further comprising the means for moving the body partially out of the sleeve and means for returning the body to the fully inserted position in the sleeve is two opposing gripping concavities arranged on the sleeve, a beveled nut and spring retainer knob removably attached to the body knob attachment end and a spring arranged between the knob and the sleeve, the knob arranged such that a golf ball may be fit to the beveled nut and spring retainer such that the golf ball is held in the palm of the hand with the tee-setting device held by the gripping concavities with two fingers of the same hand wherein the fingers apply force to the sleeve while the palm of the hand applies force to the body moving the body out of the sleeve and compressing the spring, and the spring returns the body to the fully inserted position when the finger and palm pressure is released.

14. The golf tee-setting device to hold, insert into the ground at a predetermined and selected tee head height above the ground, and release the golf tee, leaving the tee at the predetermined selected height as in claim 13 further comprising the means for motion of the ball bearings when the body is partially removed from the sleeve is comprised of a body spacer washer with an upper surface, a lower surface, an outer surface, and an inner surface arranged such that the body outer surface may be inserted within the washer inner surface and a multiplicity of holes arranged between the inner and outer surfaces, the body outer surface with a multiplicity of threaded attachment holes arranged such that the body spacer washer is removably attached to the body outer surface with a multiplicity of assembly screws with a head portion and a threaded portion wherein the sleeve and washer contact the ball bearings arranged in the ball bearing raceways, the washer upper surface also contacting the sleeve lower surface when the body is fully inserted into the sleeve such that the bearings are fully inserted into the raceways and when the body is partially removed from the sleeve, the washer upper surface moves away from the sleeve lower surface forming an opening arranged such that the bearings may move in the body bearing raceway.

15. The golf tee-setting device to hold, insert into the ground at a predetermined and selected tee head height above the ground, and release the golf tee, leaving the tee at the predetermined selected height as in claim 14 further comprising the means for adjustment of the tee chamber location is:

a. a height adjustment sleeve, a height adjustment top cap, a bottom base cover, a height adjustment sleeve cover, and a height adjustment spring;

b. the height adjustment sleeve substantially cylindrical with an upper end and a lower end, an outer surface and an inner surface, the outside surface containing attachment threads adjacent to the upper and lower ends, a helical groove in the height adjustment sleeve outer surface through the outer and inner surfaces and configured with an smooth contour upper surface and a corrugated contour lower surface, the groove extending from adjacent to the lower end threads to adjacent to the upper end threads, the inner surface arranged such that the device body spacer washer may be inserted in the height adjustment sleeve;

c. the height adjustment top cap with an upper surface containing an opening arranged such that the hold-release sleeve may be inserted in the opening, a lower surface with an opening arranged with internal threads wherein the top cap may be removable attached to the height adjustment sleeve upper end threads;

d. the bottom base cover with an upper surface containing an opening arranged with internal threads wherein the bottom base cover may be removable attached to the height adjustment sleeve lower end threads, the lower surface arranged with an opening wherein a golf tee may be inserted in the opening;

e. the height adjustment sleeve cover substantially cylindrical with an inner surface, an outer surface, a top end and bottom end, the inner surface arranged such that the sleeve may be inserted in the sleeve cover, the top end arranged such that it may be inserted in the top cap lower surface opening, the bottom end arranged such that it may be inserted in the base cover upper opening; and f. the height adjustment spring with an inner coil diameter an outer coil diameter, a lower end, and a upper end and arranged such that the tee hold-release sleeve outer surface may be inserted within the inner coil diameter such that and the outer coil diameter may be inserted within the height adjustment sleeve inner surface wherein the body spacer washer attachment screws are arranged such that the screw heads are contained within the height adjustment sleeve helical groove and the spring is arranged such that the spring is contained within the height adjustment sleeve, the spring lower end contacts the body spacer washer upper surface, and the spring upper end contacts the height adjustment top cap such that the spring is compressed between the top cap and body spacer washer, the spring force maintaining contact of the sleeve helical groove corrugated contour lower surface with the assembly screw head such that the corrugated groove lower surface provides resistance to rotation of the top cap, sleeve, bottom base cover and sleeve cover relative to the body and hold-release sleeve wherein the resistance retains the tee chamber location adjustment until the sleeve is rotated with sufficient force to overcome this resistance such that the tee chamber location is changed.

16. A method of inserting a golf tee into the ground using an adjustable golf tee-setting device with an operating knob attachment end on top connected to a body movably inserted in a sleeve and positioned by spring tension such that multiple ball bearings are positioned within corresponding multiple openings in the body, and a tee-insertion end on the bottom with an opening comprising:

a. setting the tee-setting device adjustment to the desired tee head height above the ground;

b. gripping the tee-setting device in a hand with the device held between 2 fingers and the palm of the hand such that force may be applied to the device between the 2 fingers and the palm of the hand;

c. applying force to the device such that the spring tension is overcome wherein the body moves within the sleeve and allows movement of the ball bearings such that a golf tee may be inserted in the device tee insertion end;

d. inserting the golf tee into the golf tee-setting device;

e. removing the force on the device such that the tee is retained in the device;

f. inserting the golf tee into the ground using downward force applied by 2 fingers and the heel of the hand until the device tee insertion end touches the ground; and g. applying force on the device between the 2 fingers and the palm of the hand on the device such that the device is disengaged from and may be removed from the inserted golf tee.

17. The method of inserting a golf tee into the ground using a tee-setting device with an operating knob attachment end on top connected to a body movably inserted in a sleeve and positioned by spring tension such that multiple ball bearings are positioned within corresponding multiple openings in the body, and a tee-insertion end on the bottom of claim 16 further comprising:

i. placing a golf ball on the tee-setting device operating knob attachment end between steps a and b;

ii. performing steps b. and f. by applying force on the device using 2 fingers on the device and the palm of the hand on the ball; and iii performing step e. using 2 fingers on the device and the heel of the hand on the ball.

* * * * *